United States Patent [19]

Holmes

[11] Patent Number: 4,494,104

[45] Date of Patent: Jan. 15, 1985

[54] THERMAL FUSE

[75] Inventor: Edward S. B. Holmes, Almonte, Canada

[73] Assignee: Northern Telecom Limited, Montreal, Canada

[21] Appl. No.: 514,444

[22] Filed: Jul. 18, 1983

[51] Int. Cl.[3] ..... H01H 37/76; H01H 85/04

[52] U.S. Cl. ..... 337/403; 337/166; 337/296; 337/297

[58] Field of Search ..... 337/401, 402, 403, 404, 337/405, 297, 296, 295, 160, 183, 184, 185, 166

[56] References Cited

U.S. PATENT DOCUMENTS

| | | | |
|---|---|---|---|
| 3,271,544 | 9/1966 | Ragan | 337/297 |
| 3,386,062 | 5/1968 | Kozacka et al. | 337/296 |
| 3,763,454 | 10/1973 | Zandonatti | 337/404 |

*Primary Examiner*—Harold Broome
*Attorney, Agent, or Firm*—Thomas Adams

[57] ABSTRACT

A fuse for responding to external temperatures to interrupt an electrical circuit, for example for interrupting a telephone battery feed in response to the temperature of a battery feed resistor, comprises a substrate carrying a pair of electrodes defining a gap between them. A fuse link, for example a gold strip, extends across the gap to interconnect the electrodes electrically. A film of solder overlies the fuse link and overlaps at least partly at least one of the electrodes. The fuse link is soluble in the molten solder so when the temperature of the solder paste exceeds its melting point, it melts, dissolves the fuse link, and retreats from the gap to sever the electrical connection between the electrodes.

The fuse and a resistor whose temperature is to be detected, may be provided on a single substrate.

11 Claims, 3 Drawing Figures

THERMAL FUSE

The invention relates to fuses, particularly for responding to external temperatures to interrupt an electrical circuit, and is especially, but not exclusively, applicable to fuses for protecting battery feed resistors connected to telephone lines.

Various protection arrangements are provided to protect equipment terminating a telephone line against voltage and current surges on the line. Nevertheless it is possible for a current overload to be sustained long enough to cause overheating of the battery feed resistor which is connected in series with the line. There is a need, therefore, for a fuse which will interrupt the line circuit when the temperature of the battery feed resistor becomes excessive.

An object of the present invention is to provide a fuse which is suitable for such a purpose.

According to the present invention a fuse comprises:

(i) a substrate;

(ii) a pair of electrodes disposed upon the substrate so as to define a gap therebetween;

(iii) a fuse link extending across said gap to interconnect said electrodes electrically;

(iv) a film of solder overlying said fuse link and overlapping at least partly at least one of said pair of electrodes;

the fuse link being formed of a material which is soluble in the molten solder;

the arrangement being such that when its melting point is exceeded the solder melts, dissolves the fuse link, and retreats from the gap, thereby separating the electrodes electrically. Preferably the film overlaps part of each of said electrodes.

In its application to protecting a resistor, such as a battery feed resistor, the fuse would be connected with its electrodes in series with the resistor and the substrate would be arranged to sense the temperature of the resistor.

The fuse and the resistor may be formed, conveniently using thick film techniques, upon the same substrate, either on the same surface or on opposite surfaces.

In preferred embodiments the fuse link is a layer of gold, conveniently deposited onto a substrate of ceramic material, for example alumina.

A protective film, for example an ultraviolet curable organic overcoat may be provided over the device, especially to retain the solder paste in position and protect it from being removed by subsequent cleaning processes. The fuse may be combined on a single substrate with a resistor, the temperature of which is to be sensed.

An embodiment of the invention will now be described by way of example only and with reference to the accompanying drawing, in which.

Figure 1:
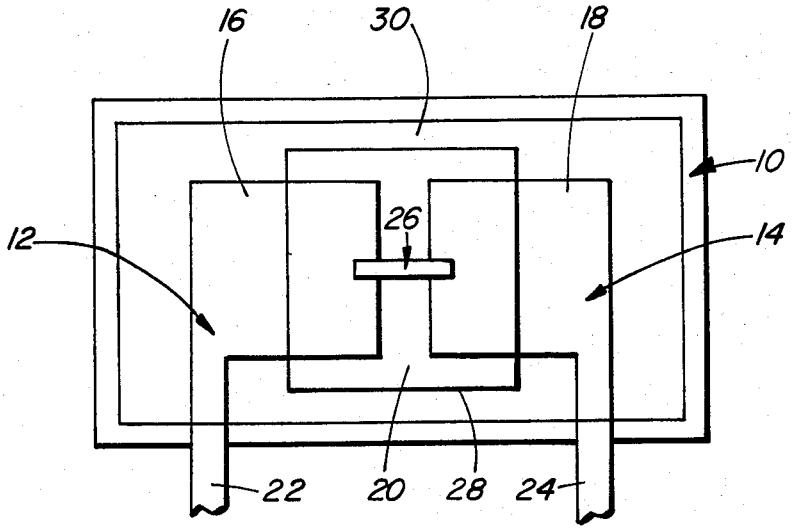
FIG. 1 shows a plan view of a fuse operable by indirect heating rather than internally-generated heating of its fuse link.

In the drawing a fuse comprises a substrate 10 of ceramic material, such as about 96% alumina. The substrate 10 supports two electrodes 12 and 14, respectively of Pd/Ag alloy thick film paste, 12 to 15 microns fired thickness, (e.g. Dupont 6130-Trade Mark). The electrodes 12 and 14 comprise rectangular portions 16 and 18, respectively, disposed side-by-side with a gap 20 between them. In a practical embodiment the gap was 0.040 inches wide. Extension arms 22 and 24, respectively, project parallel to each other from the outer parts of the rectangular portions 16 and 18 and serve as terminals for connecting the fuse into an electrical circuit.

The two electrodes 12 and 14 are interconnected by a fuse link in the form of a strip of gold 26 which bridges the gap 20 at its middle. The gold strip 26 is conveniently deposited as a thick film paste about 5 to 8 microns fired thickness (e.g. Dupont 4019-Trade Mark), by conventional techniques to extend across the ceramic substrate in the gap 20 and to overlie at each end the upper surface of the respective one of electrodes 12 and 14.

A layer of solder paste 28, about 140 microns thick overlies the fuse link 26, the gap 20 and a substantial part (typically half) of each of electrodes 12 and 14 adjacent the gap 20. A U.V. curable organic overcoat 30 overlies at least the solder paste 28, and preferably all of the fuse area, to protect it.

The solder paste 28 must be chosen to melt at the temperature at which the fuse is required to operate, and so that, when molten, it will leach the fuse link. In the case of a gold fuse link, a tin content solder is appropriate, for example 62% tin, 36% lead, 2% silver which will melt at about 190° C. A flux is also provided conveniently as a constituent of the paste, so that the molten solder will flow onto the electrodes 12 and 14 and hence separate at the gap 20 due to the non-wetting nature of the ceramic in the gap 20.

In operation, the fuse is located near to the device which is expected to overheat and its terminals 22 and 24 are connected in the electrical circuit. When the device gets sufficiently hot, the solder paste melts, leaches the gold fuse link, separates into a globule on each electrode, and thus interrupts the electrical circuit.

Figure 2:
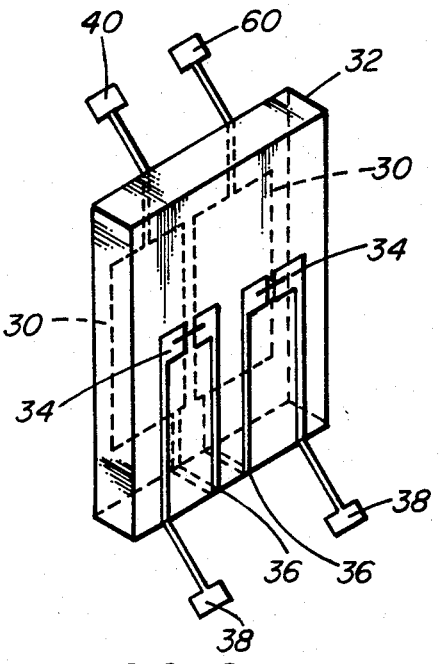
FIG. 2 is a perspective view of such fuses and resistors combined on a single substrate.
Figure 3:
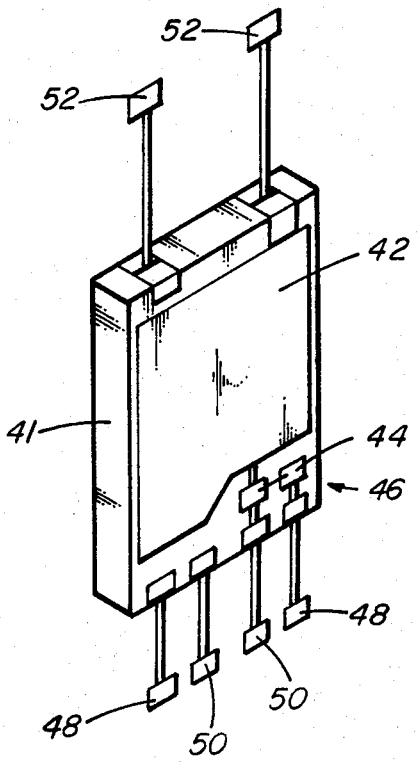
FIG. 3 is a perspective view of similar combination having a fuse and a resistor on each side of the substrate.

FIGS. 2 and 3 illustrate how the fuse may be combined with a resistor, such as a battery feed resistor. In FIG. 2, two resistors 30 are provided on one side of a ceramic or other substrate 32. Two fuses 34 are aligned, one with the middle of each resistor on the other side at the substrate 32. Each fuse 34 is connected in series with the associated resistor by a link 36 extending around the edge of the substrate 32. Terminals 38 and 40 connected to the free ends of the resistor and fuse, respectively, serve to connect the device externally.

FIG. 3 shows an alternative configuration in which a resistor and a serial fuse are deposited on each side of the substrate 41. As shown the resistor 42 is generally rectangular except for an indent area 46 at one corner. The fuse 44 is deposited in this indent area 46 and has one electrode connected to an edge connector 48, and the other electrode connected to both a second edge connector 50 and one edge of the resistor 42. The opposite edge of the resistor 42 is connected to an edge connector 52. This "three lead" connection is particularly useful for battery feed applications for telephone circuits.

Preferably each resistor 30 is deposited upon the support as a thick film. Such an arrangement provides good thermal communication between the resistor and the fuse.

It should be noted that the resistors and fuses have been duplicated so that one can be connected in each line of a supply. However, it is envisaged that a device might comprise a single resistor and fuse.

It will be appreciated that the fuse might be modified without departing from the scope of the invention. For example, a different material might be used for the fuse link, for example silver, provided a suitable solder is also selected which will leach the fuse link and still melt at the required temperature.

An advantage of embodiments of the present invention is that their operating temperature can readily be varied, during manufacture, merely by varying the proportions of the constituents of the solder, which of course alters its melting point.

It should also be appreciated that although fuses embodying the invention are especially suitable for battery feed applications they can also be applied elsewhere, generally where there is a need for a fuse which interrupts an electrical circuit at a given temperature rather than at a given current load.

What is claimed is:

1. A fuse comprising:

(i) a substrate;

(ii) a pair of electrodes disposed upon the substrate and spaced apart to define a gap between them;

(iii) a fuse link extending across said gap in intimate relationship with the substrate and interconnecting said electrodes electrically;

(iv) a film of solder intimately overlying said fuse link and at least part of at least one of said electrodes, the solder, when molten, being capable of dissolving said fuse link;

the arrangement being such that when its melting point is exceeded the solder will melt, dissolve the fuse link and retreat from the gap thereby severing the electrical connection between the electrodes.

2. A fuse comprising:

(i) a substrate;

(ii) a pair of electrodes disposed upon the substrate and spaced apart to define a gap between them;

(iii) a fuse link extending across said gap and interconnecting said electrodes electrically;

(iv) a film of solder overlying said fuse link and at least part of each of said electrodes, the solder, when molten, being capable of dissolving said fuse link;

the arrangement being such that when its melting point is exceeded the solder will melt, dissolve the fuse link and retreat from the gap thereby severing the electrical connection between the electrodes.

3. A fuse as defined in claim 1, wherein said fuse link is made of gold and said solder comprises a tin/lead solder.

4. A fuse as defined in claim 1, wherein said substrate is of ceramic material.

5. A fuse as defined in claim 1, including flux overlying at least said part of each of said electrodes.

6. A fuse as defined in claim 1, wherein said film comprises solder and flux.

7. A fuse as defined in claim 1 or 2, wherein said film overlies at least part of each electrode.

8. A fuse as defined in claim 1 or 2, mounted with a resistor on a common support, the fuse and resistor being interconnected electrically and in thermal communication.

9. A fuse as defined in claim 8, mounted on one side of the support, the resistor provided on the other side of the support in substantial alignment therewith, said resistor being connected electrically in series with said fuse.

10. A fuse as defined in claim 8, wherein said resistor and said fuse are provided on the same side of said support.

11. A fuse as defined in claim 8, wherein said resistor is a film resistor.

* * * * *